US009888814B2

(12) United States Patent
Malone et al.

(10) Patent No.: US 9,888,814 B2
(45) Date of Patent: Feb. 13, 2018

(54) APPARATUS SECURING A LINER TO A BASIN AND A CORRESPONDING METHOD FOR WASHING A PATIENT

(71) Applicant: CMC HYGEA LIMITED, Waterford (IE)

(72) Inventors: Michael Malone, Waterford (IE); Michael Cloney, Enniscorthy (IE); Anita Cambie, Waterford (IE)

(73) Assignee: CMC HYGEA LIMITED, Waterford (IE)

( * ) Notice: Subject to any disclaimer, the term of this patent is extended or adjusted under 35 U.S.C. 154(b) by 233 days.

(21) Appl. No.: 14/648,832

(22) PCT Filed: Dec. 4, 2013

(86) PCT No.: PCT/IE2013/000026
§ 371 (c)(1),
(2) Date: Jun. 1, 2015

(87) PCT Pub. No.: WO2014/087391
PCT Pub. Date: Jun. 12, 2014

(65) Prior Publication Data

US 2015/0342417 A1 Dec. 3, 2015

(30) Foreign Application Priority Data

Dec. 4, 2012 (IE) ..... S2012/0524
Nov. 5, 2013 (IE) ..... S2013/0339

(51) Int. Cl.
*A47K 1/04* (2006.01)
*A47K 1/06* (2006.01)
(Continued)

(52) U.S. Cl.
CPC ..... *A47K 1/04* (2013.01); *A47K 1/06* (2013.01); *A61G 7/0005* (2013.01); *B65F 1/06* (2013.01)

(58) Field of Classification Search
CPC ..... B65F 1/06; B65F 1/1415; B65B 67/1233; A47K 1/04; A47K 1/06; A61G 7/0005
(Continued)

(56) References Cited

U.S. PATENT DOCUMENTS 4,027,774 A * 6/1977 Cote ..... B65F 1/06 248/99
4,664,347 A * 5/1987 Brown ..... B65F 1/06 248/97
(Continued)

FOREIGN PATENT DOCUMENTS

DE 20 20 978 A1 11/1971
DE 26 42 823 A1 3/1978
(Continued)

OTHER PUBLICATIONS

International Search Report for PCT/IE2013/000026 dated May 8, 2014.
Written Opinion for PCT/IE2013/000026 dated May 8, 2014.

*Primary Examiner* — Tuan N Nguyen
(74) *Attorney, Agent, or Firm* — Sughrue Mion, PLLC

(57) ABSTRACT

Apparatus (1) for washing a bedridden patient comprises a basin (2) and a disposable water impermeable flexible liner (3) for lining a hollow interior region (5) of the basin (2). Retaining members (35) in retaining member accommodating recesses (37) located in corners (10) of the basin (2) engage engagement openings (30) formed in the liner (3) adjacent a peripheral upper edge (24) thereof and adjacent corners (27) of a peripheral wall (19) of the liner (3) for releasably securing and retaining the liner (3) to the basin (2). The basin (2) lined with the liner (3) is charged with
(Continued)

Figure 1:
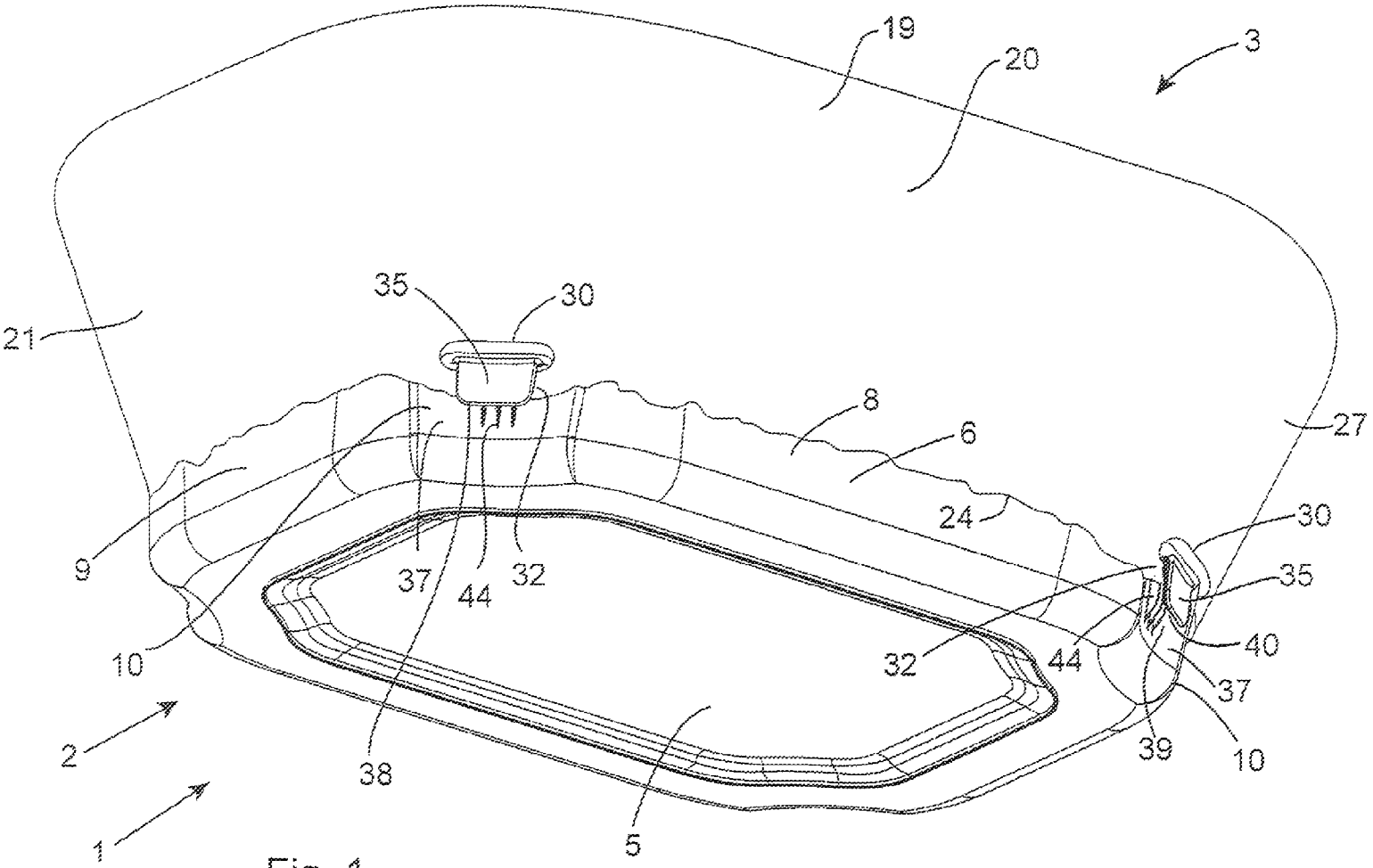

water for washing the patient. On completion of washing, the liner (3) is removed from the basin (2) for disposal.

18 Claims, 15 Drawing Sheets

(51) Int. Cl.
*B65F 1/06* (2006.01)
*A61G 7/00* (2006.01)

(58) Field of Classification Search
USPC ..... 248/95, 97, 99; 4/655
See application file for complete search history.

(56) References Cited

U.S. PATENT DOCUMENTS

| | | | | | |
|---|---|---|---|---|---|
| 5,100,087 | A * | 3/1992 | Ashby | B65F 1/06 | 248/97 |
| 5,261,553 | A | 11/1993 | Mueller et al. | | |
| 5,419,452 | A * | 5/1995 | Mueller | B65F 1/06 | 220/495.08 |
| 5,611,507 | A * | 3/1997 | Smith | B65B 67/1233 | 248/99 |
| 6,772,800 | B1 | 8/2004 | Garcia | | |
| 7,243,811 | B1 | 7/2007 | Ramsey | | |
| 2013/0232923 | A1* | 9/2013 | Beversluis | B65F 1/1415 | 248/99 |

FOREIGN PATENT DOCUMENTS

| | | | |
|---|---|---|---|
| FR | 2 900 559 | A1 | 11/2007 |
| JP | 2001-270049 | A | 10/2001 |

* cited by examiner

APPARATUS SECURING A LINER TO A BASIN AND A CORRESPONDING METHOD FOR WASHING A PATIENT

CROSS REFERENCE TO RELATED APPLICATIONS

This application is a National Stage of International Application No. PCT/IE2013/000026 filed Dec. 4, 2013, claiming priority based on Irish Patent Application Nos. S2012/0424 filed Dec. 4, 2012 and S2013/0339 filed Nov. 5, 2013, the contents of all of which are incorporated herein by reference in their entirety.

The present invention relates to apparatus for washing a patient, and in particular, the invention relates to apparatus for washing a patient for minimising the transmission of infections from one patient to another through washing of patients using the same basin. The invention also relates to a method for providing a basin for washing a patient, and further the invention relates to a basin and a liner for lining a basin.

Healthcare associated infections are rampant in hospitals, nursing homes and the like, and in particular, in Irish hospitals. Such infections are commonly caused by pathogens, which are commonly referred to as MRSA, *ecoli* and other such pathogens. Indeed, Ireland has one of the highest incidents in Europe of the transmission from patient to patient of such healthcare associated infections.

Recent literature shows that healthcare associated infections are transmitted through wash basins which are used for washing patients. Washing an infected patient using a wash basin results in contamination of the wash basin with pathogens, which are then transmitted to patients which are subsequently washed in that wash basin. It has been found that rinsing a wash basin after each use is insufficient to dispose of pathogens therein.

There is therefore a need for apparatus and a method for minimising the transmission of infections through washing of patients.

The present invention is directed towards providing apparatus for washing a patient, and also towards a method for providing a basin for washing a patient. The invention is also directed towards a basin and a liner for lining a basin.

According to the invention there is provided a basin defining a hollow interior region and an exterior surface, and comprising at least two spaced apart retaining means located on the basin for releasably engaging and retaining a liner lining the hollow interior region of the basin.

Preferably, the retaining means are located on the exterior surface of the basin. Advantageously, each retaining means comprises a retaining member extending downwardly from the exterior surface of the basin and terminating in a distal end spaced apart from the exterior surface of the basin.

Ideally, each retaining member defines with the exterior surface of the basin a gap therebetween for accommodating a portion of the liner therein.

In one aspect of the invention at least one tooth element extends from one of each of the retaining members and the exterior surface of the basin adjacent each retaining member into the gap towards the other one of the corresponding retaining member and the exterior surface of the basin, each tooth element terminating short of the said other one of the corresponding retaining member and the exterior surface of the basin for releasably retaining the corresponding portion of the liner therebetween. Preferably, at least one of the tooth elements extends from each of the retaining members and the exterior surface of the basin adjacent each of the retaining members, the tooth elements extending from the exterior surface of the basin adjacent each of the retaining members and the corresponding retaining member co-operating with each other for releasably retaining the corresponding portion of the liner therebetween. Advantageously, the number of the tooth elements extending from the exterior surface of the basin adjacent each of the retaining members and the number of tooth elements extending from the corresponding retaining member differs by one tooth element, and the at least one tooth element extending from the one of the exterior surface of the basin adjacent each retaining member and the corresponding retaining member with the least number of tooth elements extends between the tooth elements extending from the other one of the exterior surface of the basin and the retaining member.

In another aspect of the invention the number of the tooth elements extending from each of the retaining members is less than the number of the tooth elements extending from the exterior surface of the basin adjacent the corresponding retaining member. Preferably, two tooth elements extends from each retaining member.

Preferably, the tooth elements extending from the exterior surface of the basin adjacent each of the retaining members and the tooth elements extending from the corresponding retaining member extend substantially parallel to each other.

Advantageously, the at least one tooth element extending from each of the retaining members extends substantially longitudinally along the corresponding retaining member.

In one embodiment of the invention each retaining member is located in a corresponding retaining member accommodating recess formed into the exterior surface of the basin. Preferably, each retaining member extends from the basin in the corresponding retaining member accommodating recess. Advantageously, each retaining member extends into the corresponding retaining member accommodating recess.

In another embodiment of the invention the basin comprises a base and a peripheral wall extending around the base and in a generally upwardly direction from the base and terminating in an upper peripheral edge, the base and the peripheral wall defining the hollow interior region and the exterior surface of the basin, and the upper peripheral edge of the peripheral wall defining an open mouth to the hollow interior region of the basin.

Advantageously, each retaining member accommodating recess is formed in the peripheral wall of the basin.

In one aspect of the invention each retaining member accommodating recess extends into the base.

Preferably, the retaining members are equi-spaced apart around the peripheral wall of the basin.

In another aspect of the invention the peripheral wall of the basin comprises a pair of spaced apart side walls extending upwardly from the base, and a pair of spaced apart end walls extending upwardly from the base and joining the side walls, the side and end walls defining corners of the peripheral wall, and each retaining member is located adjacent a corresponding one of the corners of the peripheral wall. Preferably, the corners of the peripheral wall of the basin are radiused corners.

Advantageously, four retaining members are located around the peripheral wall.

Preferably, each retaining member is located intermediate the base and the upper peripheral edge defined by the peripheral wall.

In one embodiment of the invention the retaining member is located towards the base.

In another embodiment of the invention the basin comprising a plastics material. Preferably, the plastics material of the basin comprises an antimicrobial additive. Advantageously, the antimicrobial additive comprises an inorganic silver based component in an inert glass carrier.

In another embodiment of the invention the capacity of the basin lies in the range of 3 liters to 7 liters, and preferably, the capacity of the basin lies in the range of 4 liters to 5 liters.

In another embodiment of the invention the basin is of a substantially rectangular shape in plan view, and the internal length of the basin lies in the range of 250 mm to 400 mm, and the internal width of the basin lies in the range of 200 mm to 350 mm and preferably, the internal length of the basin is approximately 320 mm, and the internal width of the basin is approximately 270 mm.

Preferably, the internal height of the basin lies in the range of 100 mm to 250 mm, and advantageously, the internal height of the basin is approximately 140 mm.

The invention also provides a liner for lining a hollow interior region of a basin, the liner defining a peripheral wall sealably closed at one end and defining a hollow interior region, the peripheral wall terminating at its other end in a peripheral edge defining an open mouth to the hollow interior region, the peripheral wall being foldable downwardly over a peripheral wall of the basin, the liner having at least two spaced apart engagement openings for releasably engaging respective retaining means of the basin when the peripheral wall of the liner is folded downwardly over the peripheral wall of the basin for releasably retaining the liner attached to the basin.

In one aspect of the invention each engagement opening is located adjacent the peripheral edge of the peripheral wall of the liner.

In another aspect of the invention each engagement opening is located in the peripheral wall of the liner.

In a further aspect of the invention each engagement opening is located in the peripheral wall of the liner adjacent the peripheral edge thereof but spaced apart from the peripheral edge.

Preferably, each engagement opening extends through the peripheral wall of the liner.

Alternatively, each engagement opening is defined by a loop of material extending from the peripheral edge of the liner at spaced apart locations and the peripheral edge of the liner between the spaced apart locations at which the loop of material extends. Preferably, each loop of material defining a corresponding one of the engagement openings is integrally formed in one piece with the liner.

In one aspect of the invention the engagement openings are equi-spaced apart around the peripheral wall of the liner. Preferably, the liner comprises four of the engagement openings.

In one aspect of the invention the peripheral wall of the liner is of height greater than the height of a peripheral wall of the basin to be lined by the liner. Preferably, the peripheral wall of the liner is of height at least one and a half times the height of a peripheral wall of the basin.

In one embodiment of the invention the liner comprises a base, and the peripheral wall extends around and generally upwardly from the base and defines with the base the hollow interior region, the base being configured to line an interior surface of a base of the basin, and the peripheral wall being configured to line an inner surface of a peripheral wall of the basin.

In another embodiment of the invention the peripheral wall of the liner comprises a pair of spaced apart side walls extending upwardly from the base joined by a pair of spaced apart end walls extending upwardly from the base, the side and end walls of the liner defining with the base thereof the hollow interior region of the liner, and the side and end walls defining the upper peripheral edge of the peripheral wall of the liner.

Preferably, the side and end walls of the liner define corners of the peripheral wall of the liner, and each engagement opening is located adjacent a corresponding one of the corners of the peripheral wall of the liner.

Advantageously, the corners of the peripheral wall of the liner are radiused corners.

Preferably, the liner is of a water impermeable flexible material.

In one aspect of the invention the material of the liner comprises a plastics material. Preferably, the plastics material of the liner comprises an antimicrobial additive. Advantageously, the antimicrobial additive comprises an inorganic silver based component in an inert glass carrier.

Additionally, the invention provides apparatus for washing a patient, the apparatus comprising a basin according to the invention, and a liner lining the basin. Preferably, the liner comprises a liner according to the invention.

The invention further provides apparatus for washing a patient, the apparatus comprising a basin defining a hollow interior region and an exterior surface, at least two spaced apart retaining means located on the basin, and a liner lining the hollow interior region of the basin, the liner having at least two spaced apart engagement openings releasably engaging the retaining means of the basin.

Preferably, the liner comprises a peripheral wall sealably closed at one end and defining a hollow interior region of the liner, the peripheral wall terminating at its other end in a peripheral edge defining an open mouth to the hollow interior region of the liner, the peripheral wall being foldable downwardly over a peripheral wall of the basin, the engagement openings being located for releasably engaging the respective retaining means of the basin when the peripheral wall of the liner is folded downwardly over the peripheral wall of the basin.

Advantageously, the number of engagement openings in the liner is similar to the number of retaining means in the basin.

Ideally, the locations of the engagement openings in the liner corresponds with the locations of the retaining means of the basin.

Preferably, the circumferential length of the peripheral wall of the liner is substantially similar to the circumferential length of the peripheral wall of the basin.

The invention also provides a method for providing a basin for washing a patient, the method comprising lining a hollow interior region of the basin with a liner, and releasably securing the liner to the basin.

Preferably, the method further comprises charging the liner in the basin with water prior to washing the patient, and emptying the water from the liner in the basin, disengaging the liner from the basin, removing the liner from the basin, and disposing of the liner.

In one aspect of the invention gloves worn by a person washing the patient are placed in the liner prior to disposal of the liner, and are disposed of with the liner.

In one aspect of the invention the basin comprises a basin according to the invention, and preferably, the liner comprises a liner according to the invention.

The advantages of the invention are many. The spread of healthcare associated infections from patient to patient by sequentially washing the patients using the same basin is significantly reduced, if not totally eliminated. By virtue of the provision of the liner for lining the hollow interior region of the basin, and by virtue of the fact that the liner is disposed after each patient is washed and a fresh liner is provided for lining the hollow interior region of the basin for the next patient to be washed, there is little or no contact between the basin and the washing water and the basin and the patient. Thus, by disposing of the liner after each patient is washed, any risk of the transmission of healthcare associated infections is virtually eliminated.

Another advantage of the invention is that the liner remains in position lining the hollow interior region of the basin during washing of the patient without any risk or danger of the liner disengaging the basin. This advantage is achieved by the provision of the engagement openings in the liner which are engageable with the retaining means of the basin. A particularly important advantage is achieved by providing the engagement opening in the liner to be engageable with the retaining means in the basin, and by providing the retaining means in the form of retaining members. This facilitates ready and easy engagement of the liner with and disengagement of the liner from the basin. The provision of the tooth elements associated with the respective retaining members further facilitates securing of the liner to the basin, while the liner can be readily easily disengaged from the basin.

The provision of the peripheral wall of the liner being of a flexible material and being foldable downwardly over the peripheral wall of the basin further minimises contact between the outer surface of the basin and the water for washing the patient, and the outer surface of the basin and the patient, thereby further reducing and virtually eliminating the risk of the spread of healthcare associated infections. By providing the materials of both the basin and in particular, the liner with an antimicrobial additive, the risk of the spread of healthcare associated infections is further reduced, if not totally eliminated.

Figure 2:
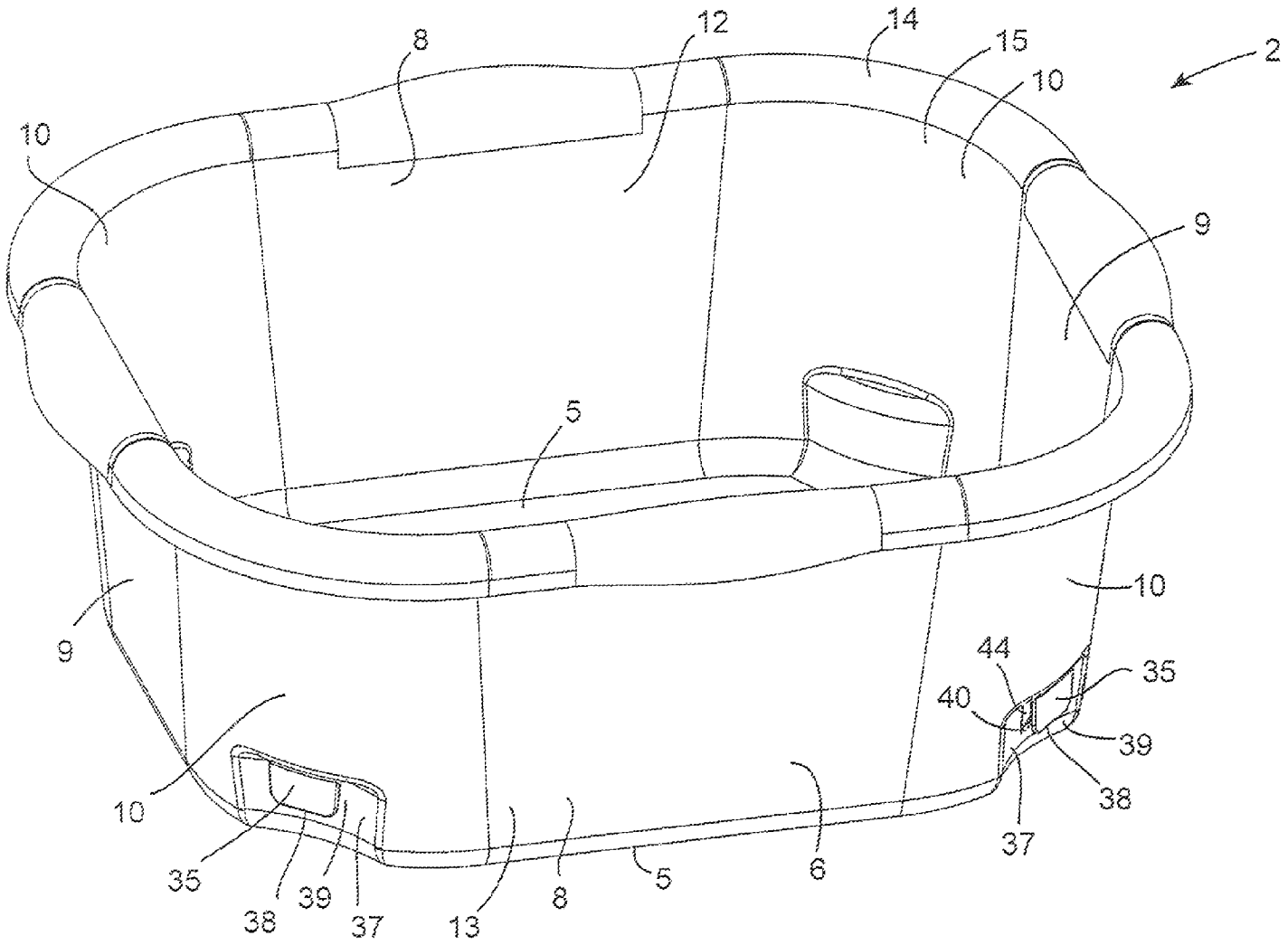
Figure 3:
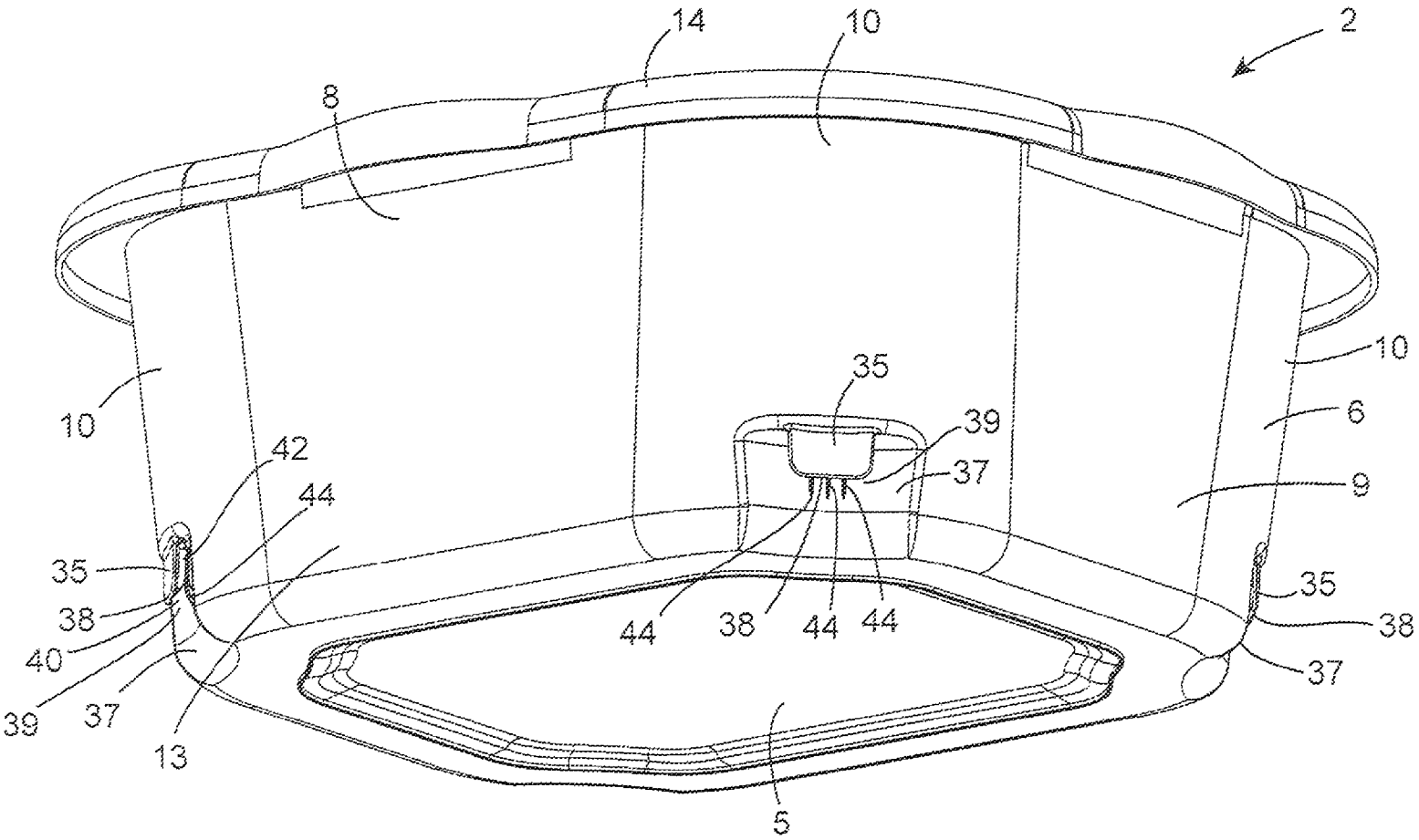
Figure 5:
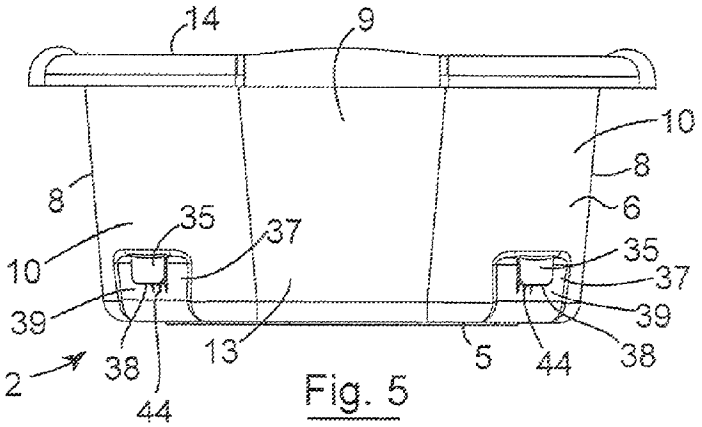
Figure 4:
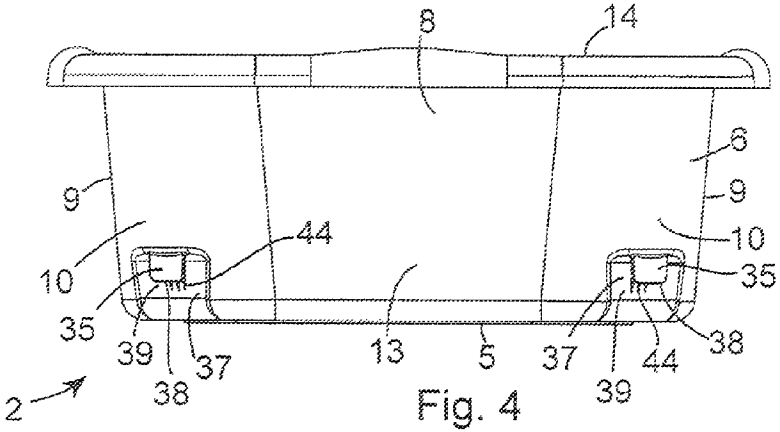
Figure 6:
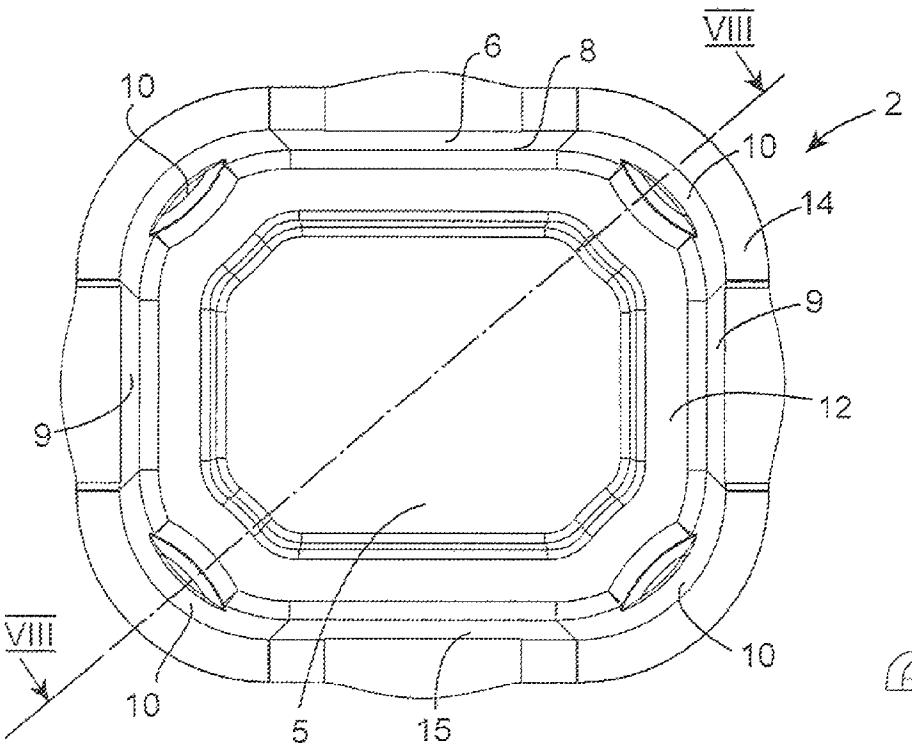
Figure 7:
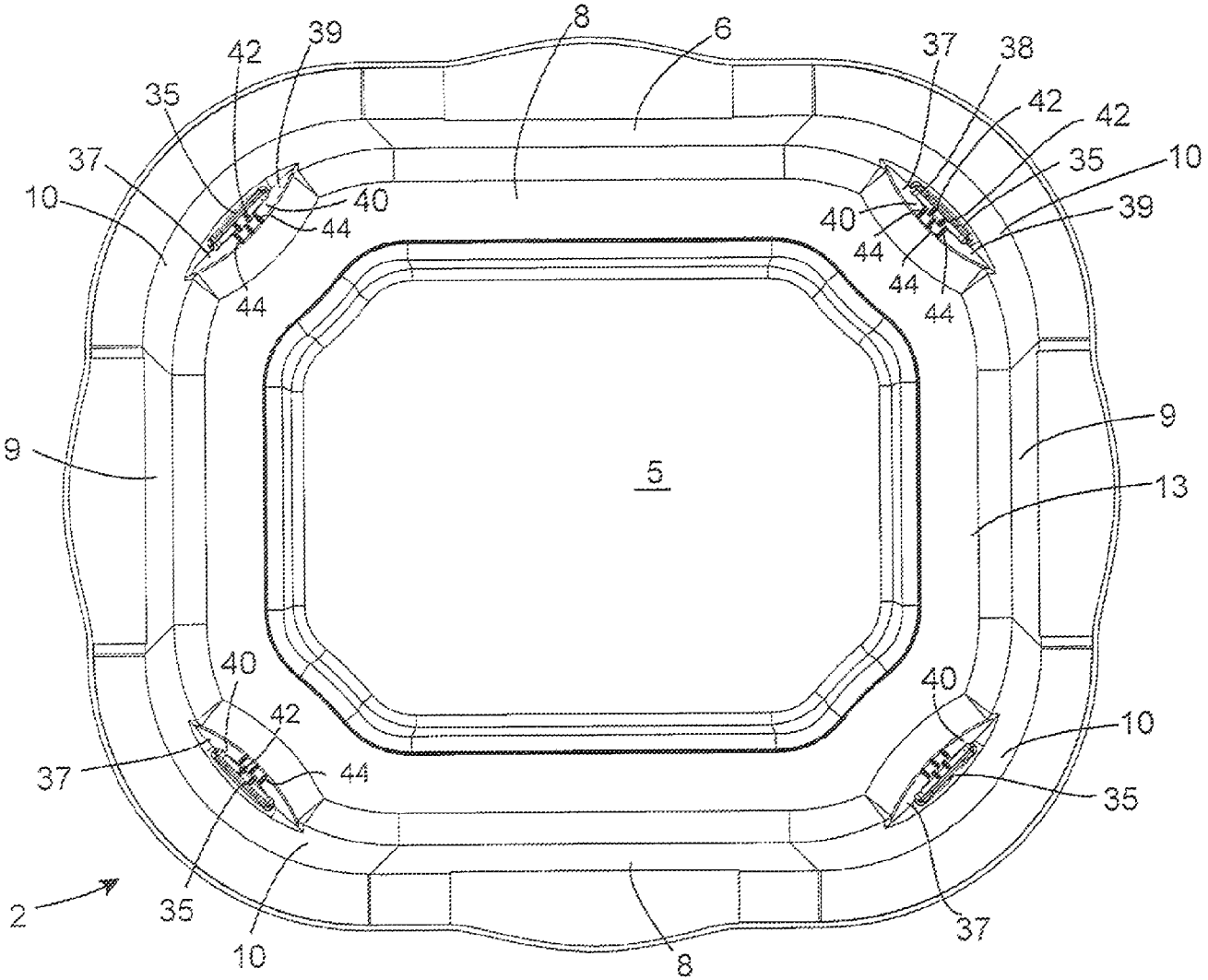
Figure 8:
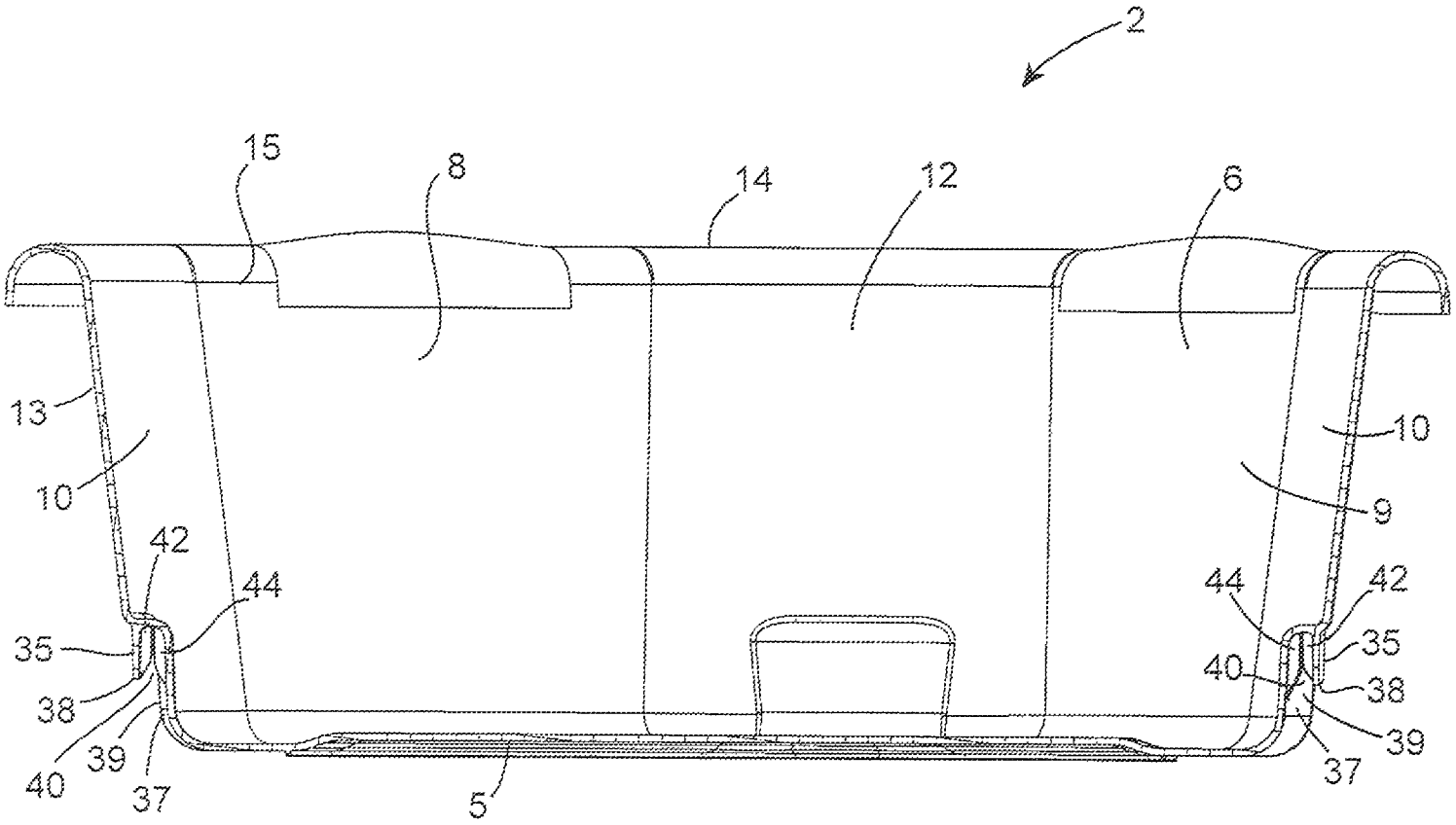
Figure 11:
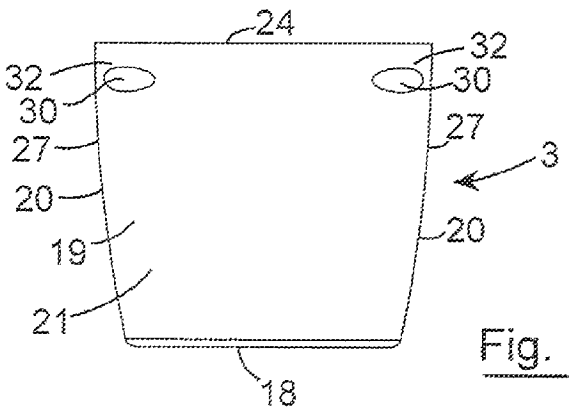
Figure 10:
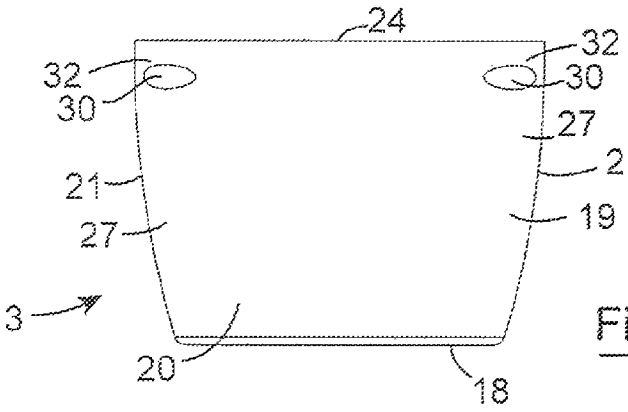
Figure 9:
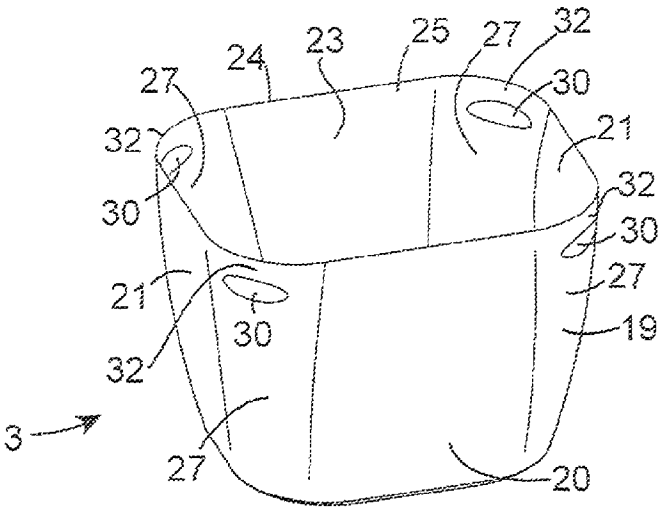
Figure 12:
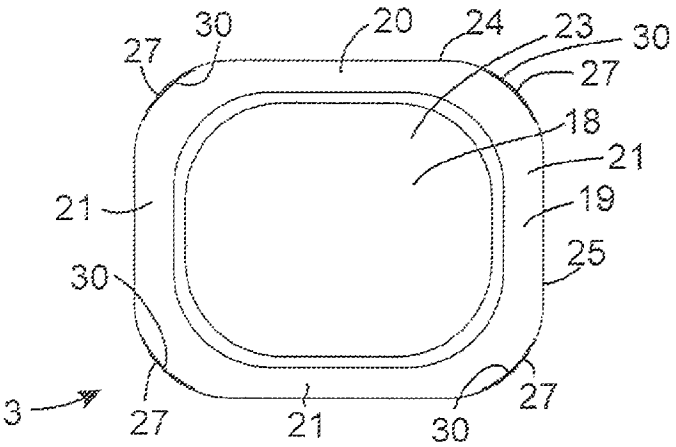
Figure 14:
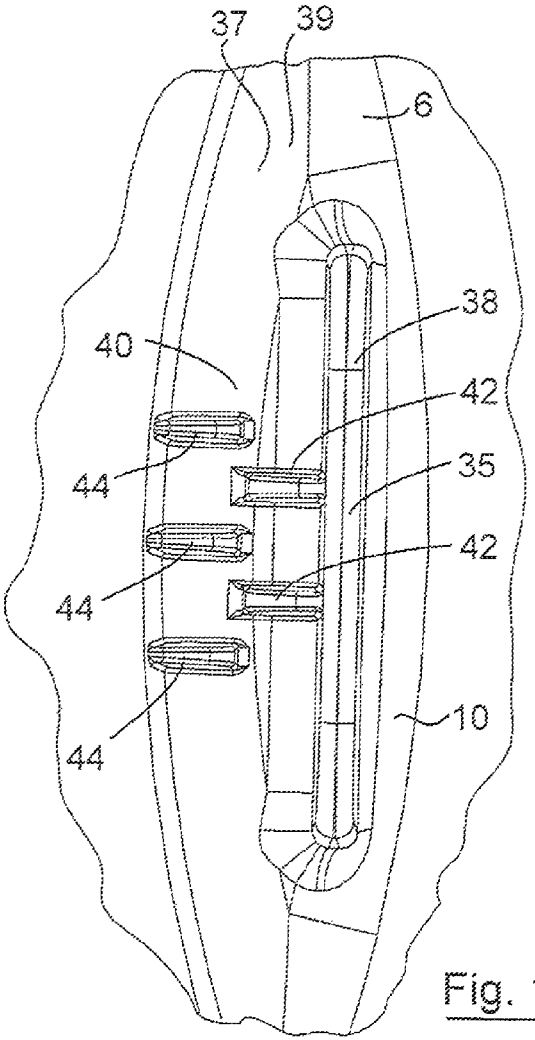
Figure 13:
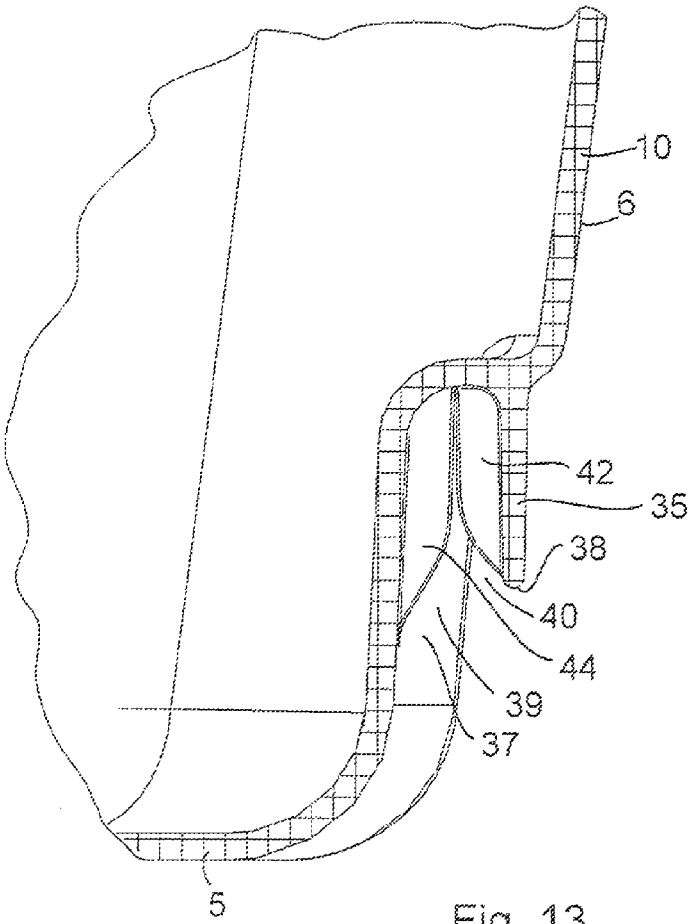
Figure 15:
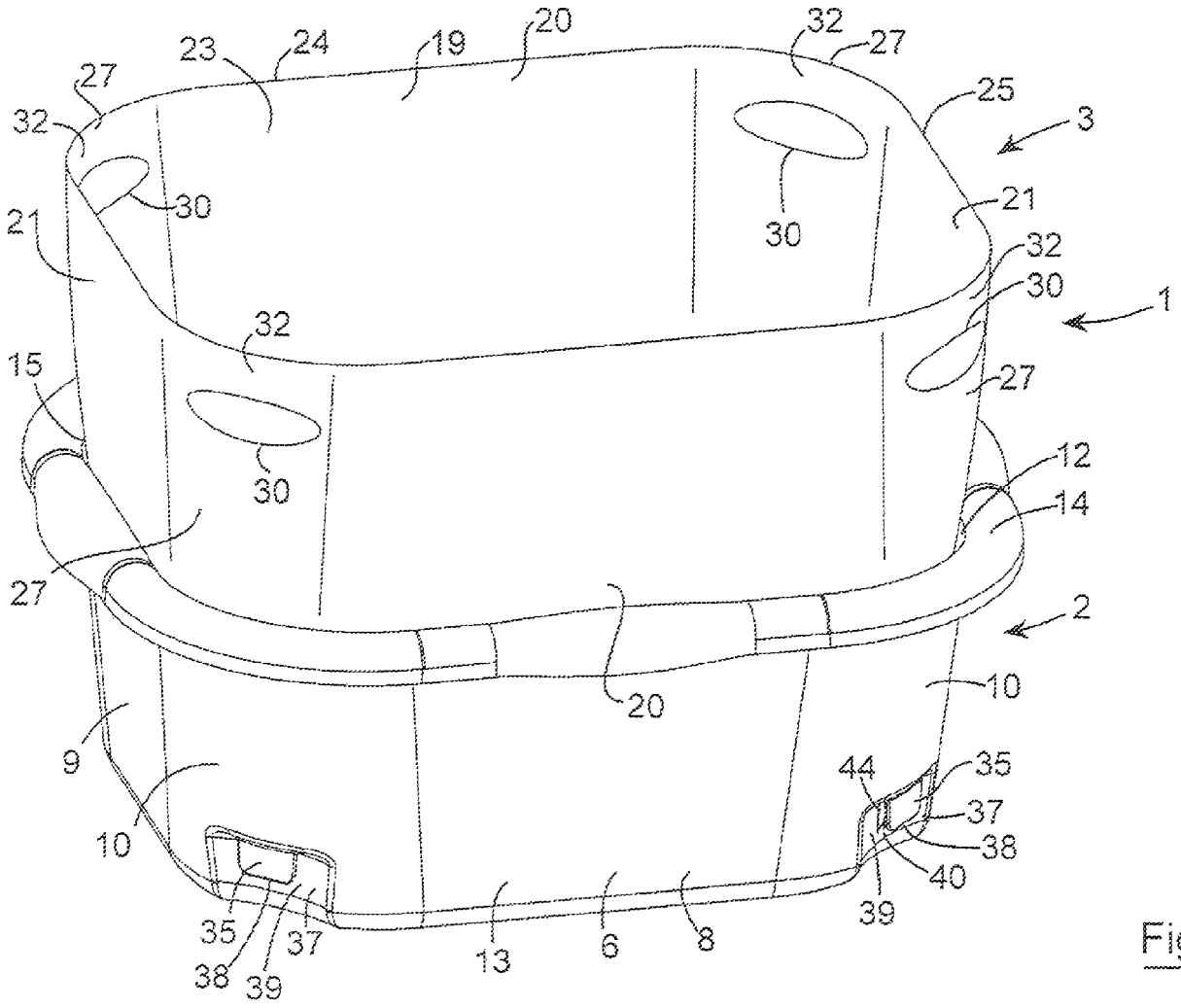
Figure 16:
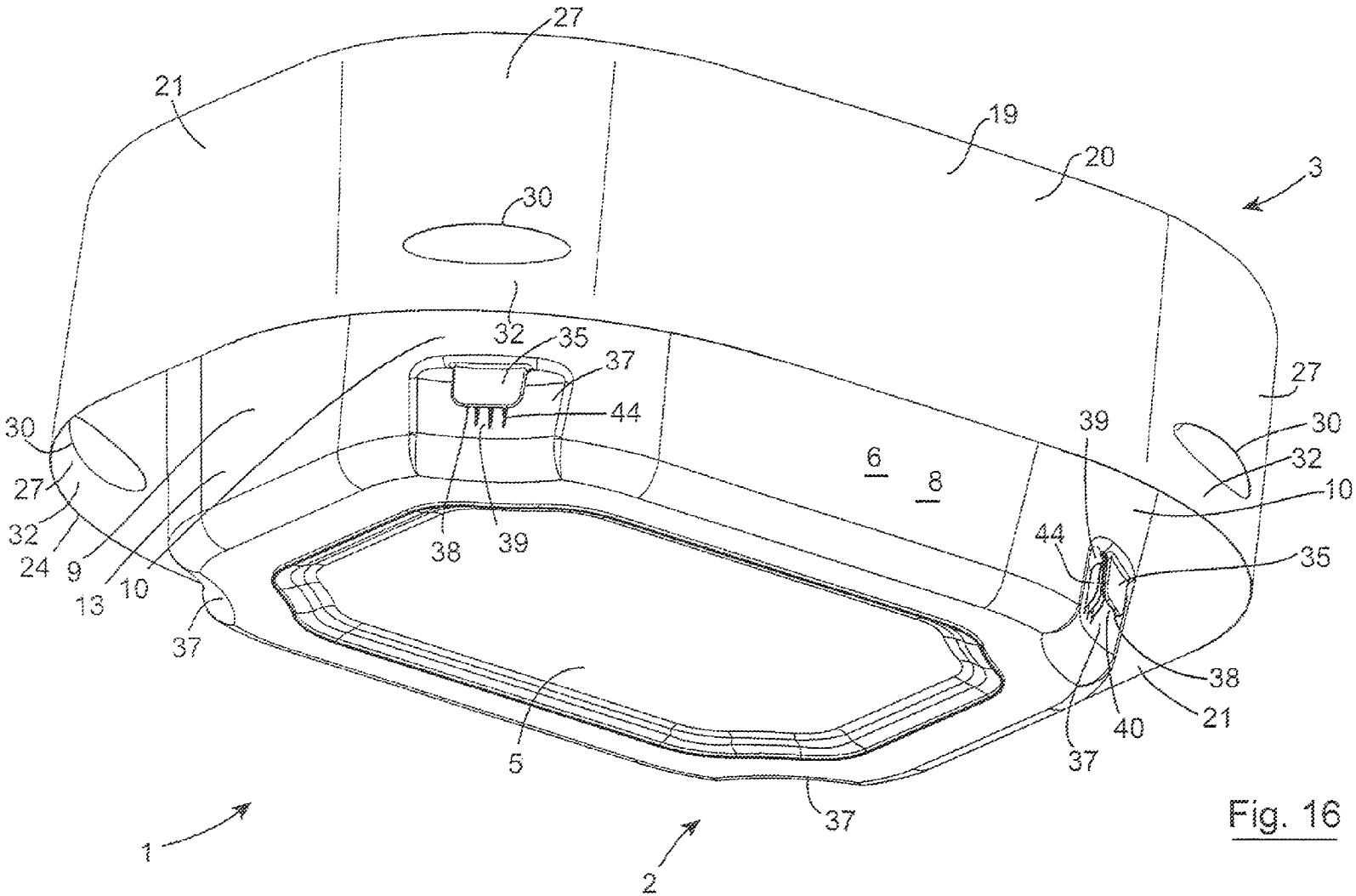
Figure 17:
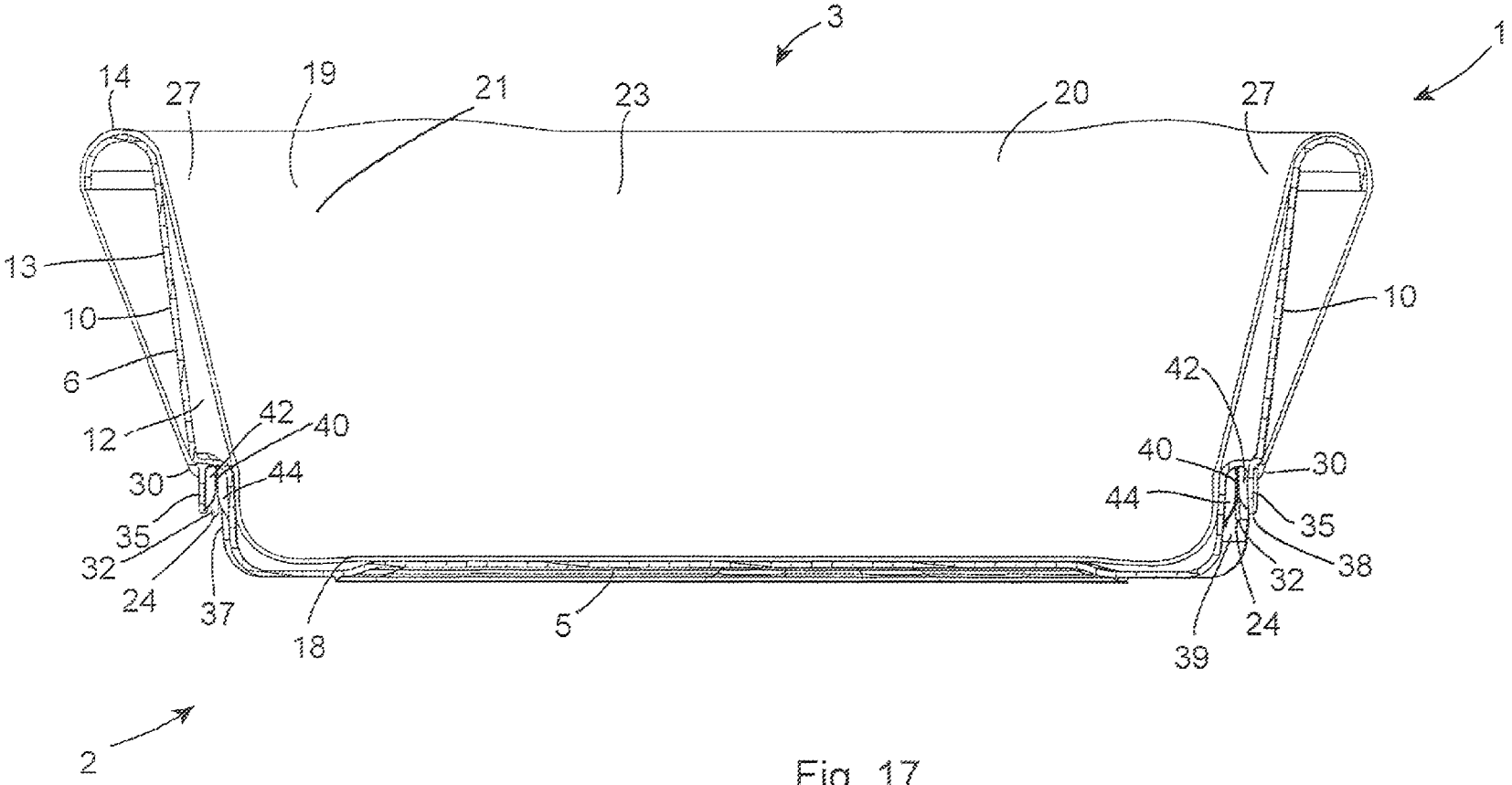
Figure 18:
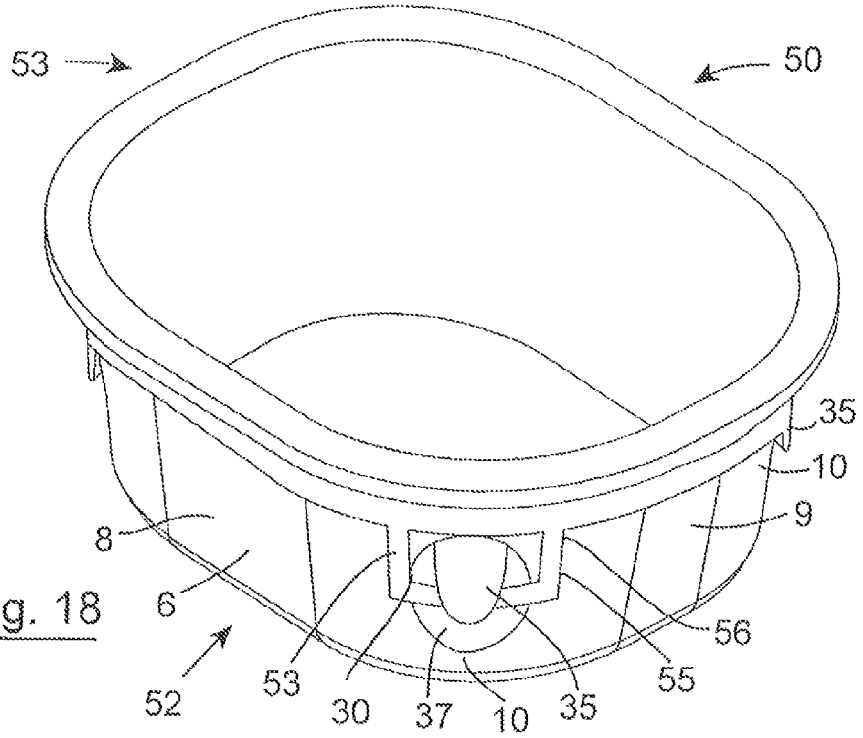
Figure 20:
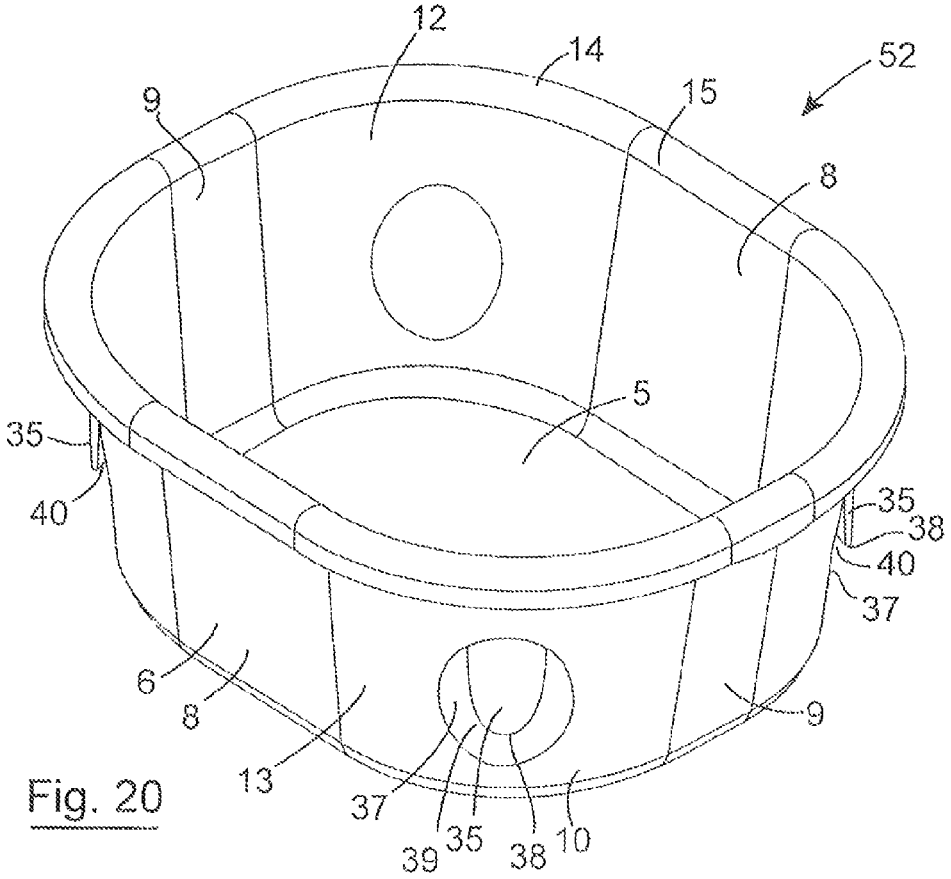
Figure 19:
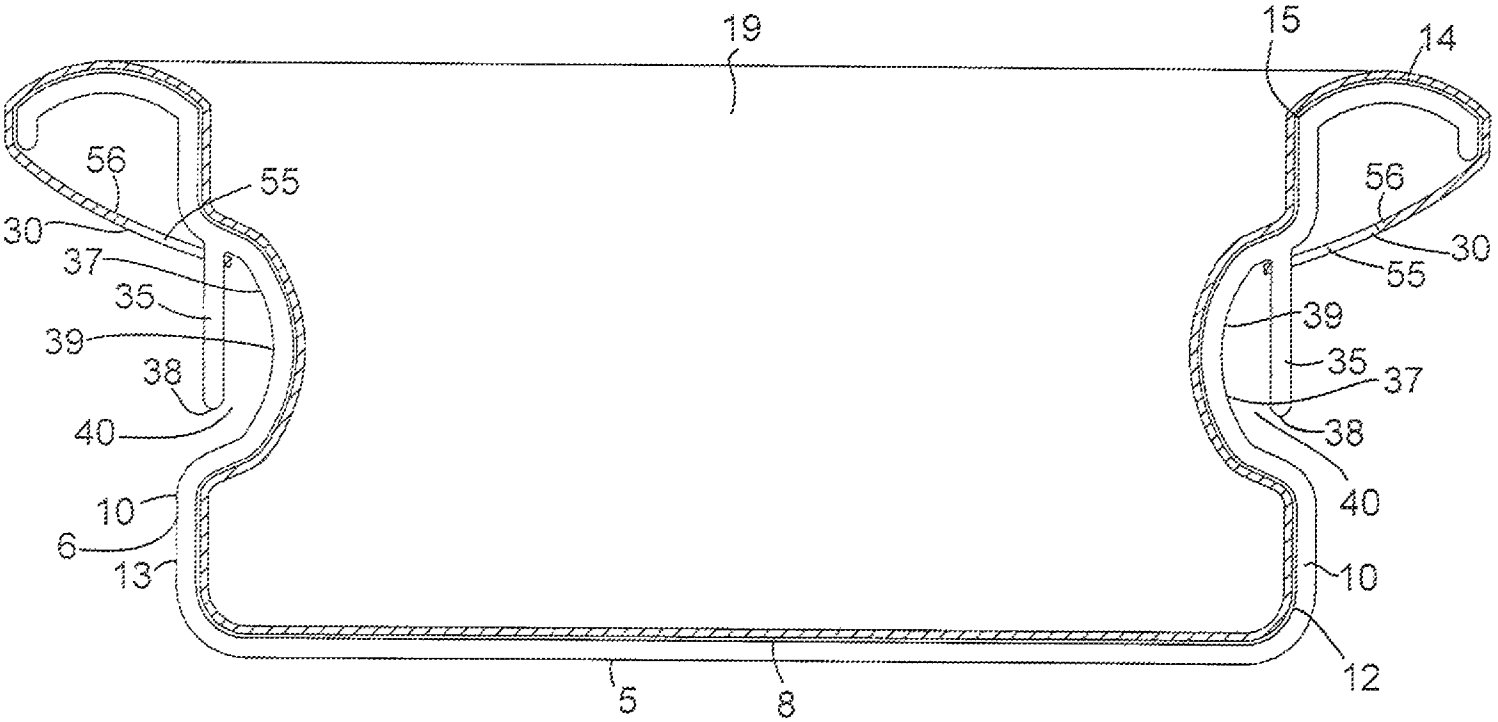
Figure 22:
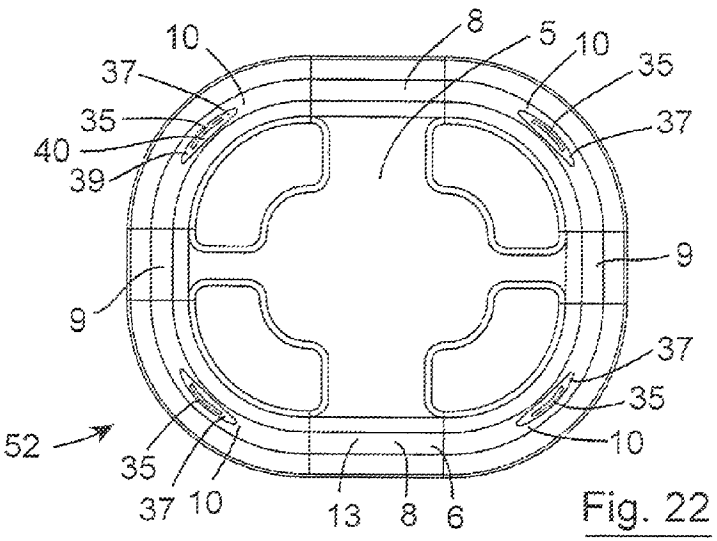
Figure 21:
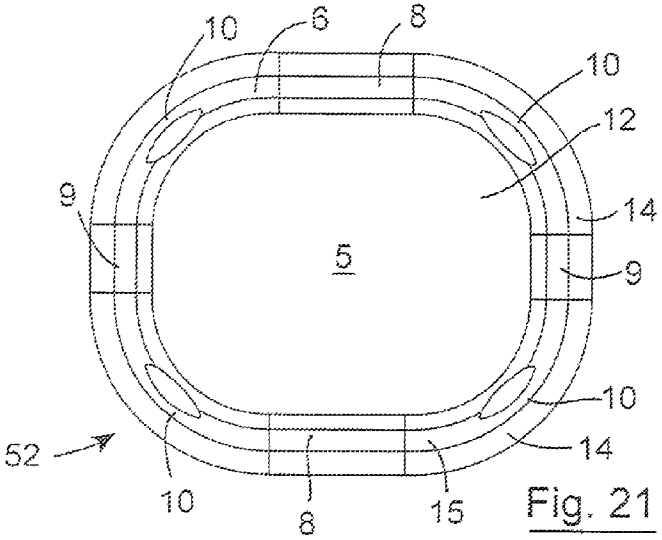
Figure 25:
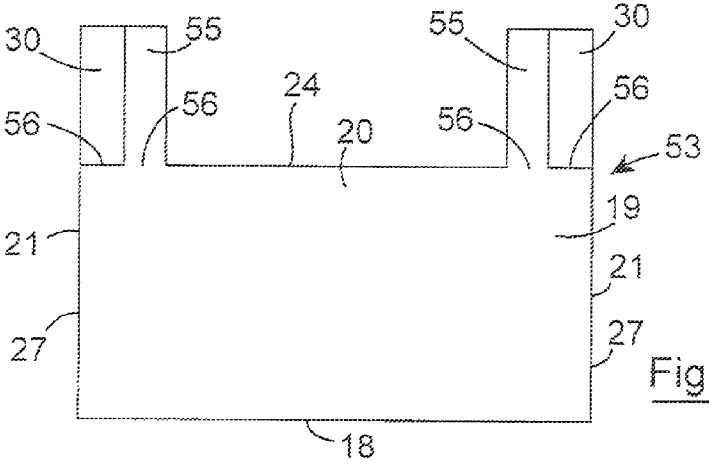
Figure 23:
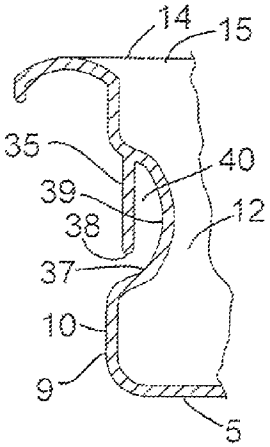
Figure 24:
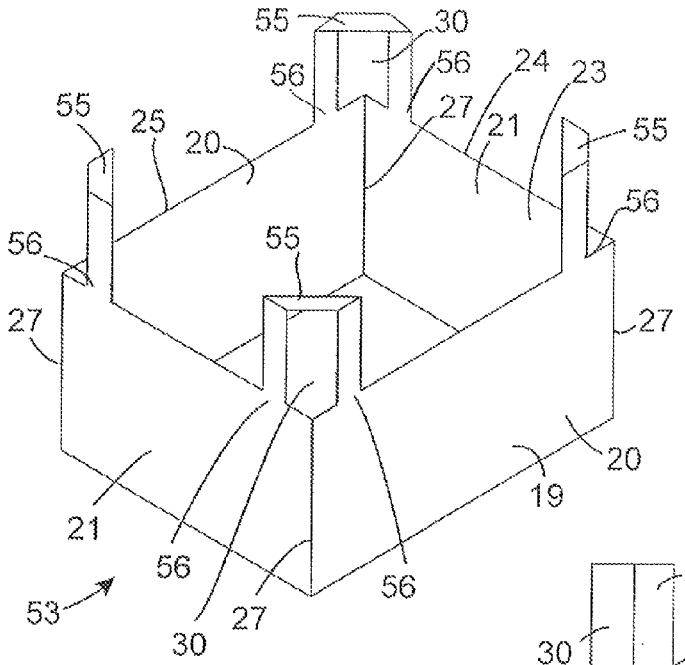
Figure 26:
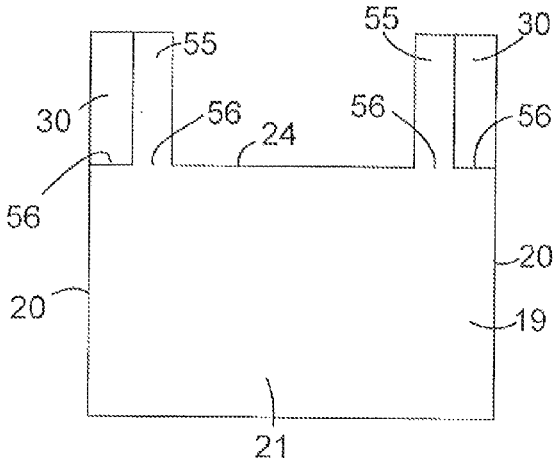
Figure 27:
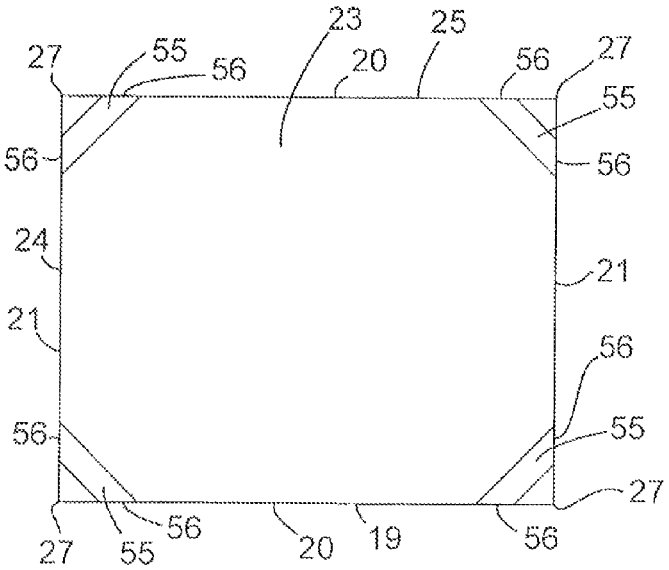

The invention will be more clearly understood from the following description of some preferred embodiments thereof, which is given by way of example only, with reference to the accompanying drawings, in which:

FIG. 1 is a perspective view of apparatus according to the invention for washing a patient comprising a basin also according to the invention and a liner also according to the invention lining the basin, FIG. 2 is a perspective view of the basin of FIG. 1, FIG. 3 is an underneath perspective view of the basin of FIG. 1, FIG. 4 is a front elevational view of the basin of FIG. 1, FIG. 5 is a side elevational view of the basin of FIG. 1, FIG. 6 is a top plan view of the basin of FIG. 1, FIG. 7 is an underneath plan view of the basin of FIG. 1, FIG. 8 is a cross-sectional elevational view of the basin of FIG. 1 on the line VIII-VIII of FIG. 6, FIG. 9 is a perspective view of the liner of FIG. 1, FIG. 10 is a front elevational view of the liner of FIG. 1, FIG. 11 is a side elevational view of the liner of FIG. 1, FIG. 12 is a top plan view of the liner of FIG. 1, FIG. 13 is an enlarged cross-sectional elevational view of a detail of the basin of FIG. 1 on the line VIII-VIII of FIG. 6, FIG. 14 is an underneath plan view of the detail of FIG. 13 of the basin of FIG. 1, FIG. 15 is a perspective view of the apparatus of FIG. 1 being prepared for use, FIG. 16 is another perspective view of the apparatus of FIG. 1 also being prepared for use, FIG. 17 is a cross-sectional elevational view of the apparatus of FIG. 1 in use, FIG. 18 is a perspective view of apparatus according to another embodiment of the invention for washing a patient comprising a basin according to another embodiment of the invention and a liner according to another embodiment of the invention lining the basin, FIG. 19 is a cross-sectional elevational view of the apparatus of FIG. 18, FIG. 20 is a perspective view of the basin of FIG. 18, FIG. 21 is a top plan view of the basin of FIG. 18, FIG. 22 is an underneath plan view of the basin of FIG. 18, FIG. 23 is a cross-sectional elevational view of a detail of the basin of FIG. 18, FIG. 24 is a perspective view of the liner of FIG. 18, FIG. 25 is a side elevational view of the liner of FIG. 18, FIG. 26 is an end elevational view of the liner of FIG. 18, and FIG. 27 is a top plan view of the liner of FIG. 18.

Referring to the drawings and initially to FIGS. 1 to 17 thereof, there is illustrated apparatus according to the invention, indicated generally by the reference numeral 1, for washing a patient, and particularly for washing a bedridden patient. The apparatus 1 comprises a basin also according to the invention, indicated generally by the reference numeral 2, and a disposable liner also according to the invention and indicated generally by the reference numeral 3 for lining the basin 2 during washing of the patient. The basin 2 is formed by injection moulding of plastics material, in this embodiment of the invention polypropylene, which includes an antimicrobial additive comprising an inorganic silver-based constituent in an inert glass carrier. The antimicrobial agent is provided in powder form and mixed with the polypropylene during the injection moulding process. In this embodiment of the invention the antimicrobial additive comprises an antimicrobial agent sold under the Trade Mark ULTRA-FRESH CA-16 by Thompson Research Associates Inc. of Ontario, Canada.

The basin 2 comprises a base 5 and a peripheral wall 6 extending around the base 5, and in a generally upward direction from the base 5. The peripheral wall 6 in this embodiment of the invention comprises a pair of spaced apart side walls 8 which are joined by spaced apart end walls 9. The side walls 8 and end walls 9 define four radiused corners 10 of the peripheral wall 6. The side and end walls 8 and 9 together with the base 5 define a hollow interior region 12 which is lined by the liner 3, and an exterior surface 13 of the basin 2. The side and end walls 8 and 9 terminate in an upper peripheral edge 14 which defines an open mouth 15 to the hollow interior region 12. The upper peripheral edge 14 is radiused to accommodate the liner 3 being folded over the side and end walls 8 and 9, as will be described in more detail below.

The liner 3 is of a water impermeable flexible plastics material, in this embodiment of the invention low density polyethylene material, which can withstand temperatures up to 106° F., and comprises an antimicrobial additive which is similar to the antimicrobial additive of the plastics material of the basin 2. The liner 3 is formed by blow moulding and is of film thickness of approximately 50 microns. The liner 3 is provided in a roll (not shown) of liners 3 which are separated from each other by respective lines of perforations (not shown) as will be well understood by those skilled in the art.

During formation of the liners 3 in the roll (not shown) of liners 3, each of the liners 3 is formed to have a base 18, and a peripheral wall 19, which when the liner 3 is erected extends around and generally upwardly from the base 18. In this embodiment of the invention when the liner 3 is erected the peripheral wall 19 forms a pair of spaced apart side walls 20 which are joined by a pair of spaced apart end walls 21. The side and end walls 20 and 21 define with the base 18 a hollow interior region 23, and the side and end walls 20 and 21 extend generally upwardly from the base 18 and terminate in the upper peripheral edge 24 of the liner 3, which defines an open mouth 25 to the hollow interior region 23.

The base 18 of the liner 3 is of area which is substantially similar to the inner area of the base 5 of the basin 2, and the circumferential length of the peripheral wall 19 of the liner 3 is substantially similar to the circumferential length of the peripheral wall 6 of the basin 2. The side and end walls 20 and 21 define radiused corners 27 of the peripheral wall 19 of the liner 3, which when the liner 3 is placed in the hollow interior region 12 of the basin 2 with the base 18 of the liner 3 abutting and aligned with the base 5 of the basin 2, the corners 27 of the liner 3 substantially coincide with the corners 10 of the basin 2 and are aligned with and abut the corners 10 of the basin 2. Additionally, the side and end walls 20 and 21 of the liner 3 are of substantially similar lengths to the lengths of the side and end walls 8 and 9, respectively, of the basin 2, so that when the base 18 of the liner 3 is in alignment with and abutting the base 5 of the basin 2, the side and end walls 20 and 21 of the liner 3 abut and are substantially aligned with the side and end walls 8 and 9 of the basin 2. In this embodiment of the invention the height of the side and end walls 20 and 21 from the base 18 of the liner 3 is approximately twice the height of the side and end walls 8 and 9 from the base 5 of the basin 2, so that the side and end walls 20 and 21 of the liner 3 can be folded over the radiused upper peripheral edge 14 of the basin 2 to extend downwardly over most of the exterior surface 13 of the side and end walls 8 and 9 of the basin 2, in order to cover most of the exterior surface 13 of the side and end walls 8 and 9.

Four engagement openings 30 extend through and are equi-spaced apart around the peripheral wall 19 of the liner 3 adjacent but spaced apart from the upper peripheral edge 24 of the peripheral wall 19 for releasably securing the liner 3 to the basin 2 as will be described below. The engagement openings 30 are located in the peripheral wall 19 of the liner 3 adjacent the respective corners 27 of the peripheral wall 19, and are spaced apart downwardly from the upper peripheral edge 24 of the peripheral wall 19 with portions 32 of the peripheral wall 19 located between the upper peripheral edge 24 of the peripheral wall 19 and the respective engagement openings 30. In this embodiment of the invention the openings 30 are of an oval shape.

Returning now to the basin 2, the basin 2 comprises four spaced apart retaining means, namely, four retaining members 35 extending downwardly from the outer surface 13 of the peripheral wall 6 of the basin 2 adjacent the respective corners 10 of the peripheral wall 6 for releasably engaging the engagement openings 30 in the liner 3 for releasably securing and retaining the liner 3 to the basin 2 with the liner 3 lining the hollow interior region 12 of the basin 2. Four retaining member accommodating recesses 37 are formed into the exterior surface 13 of the peripheral wall 6 adjacent the corners 10 of the peripheral wall 6. The retaining member accommodating recesses 37 are located in the peripheral wall 6 adjacent the base 5 of the basin 2, and also extend into the base 5 of the basin 2 adjacent the corners 10.

Each retaining member 35 extends from the exterior surface 13 of the peripheral wall 6 in the corresponding retaining member accommodating recess 37 and extends downwardly in the retaining member accommodating recess 37 to terminate in a distal end 38. Each retaining member 35 defines a gap 40 between itself and a portion 39 of the exterior surface 13 of the basin 2 within the retaining member accommodating recess 37 for accommodating the portion 32 of the peripheral wall 19 of the liner 3 between a corresponding one of the engagement openings 30 and the upper peripheral edge 24 of the peripheral wall 19 of the liner 3.

Co-operating spaced apart parallel elongated tooth elements extend into each gap 40 from the corresponding retaining member 35 and the corresponding portion 39 of the exterior surface 13 in the corresponding retaining member accommodating recess 37, namely, first tooth elements 42 which extend from the retaining members 35 and second tooth elements 44 which extend from the portions 39 of the exterior surface 13 in the retaining member accommodating recesses 37. In this embodiment of the invention two of the parallel spaced apart elongated first tooth elements 42 extend longitudinally along each retaining member 35 into the gap 40 towards the portion 39 of the exterior surface 13 within the corresponding retaining member accommodating recess 37 and terminate short of the portion 39 of the exterior surface 13. Three of the spaced apart parallel elongated second tooth elements 44 extend from the portion 39 of the exterior surface 13 within each retaining member accommodating recess 37 towards the corresponding retaining member 35 and terminate short of the corresponding retaining member 35. The first and second tooth elements 42 and 44 of each retaining member 35 and the corresponding retaining member accommodating recess 37 are located relative to each other, with the first tooth elements 42 extending between the second tooth elements 44, and with each first tooth element 42 equi-spaced apart from an adjacent pair of the second tooth elements 44, so that the first and second tooth elements 42 and 44 co-operate with each other to securely but releasably engage the corresponding portions 32 of the peripheral wall 19 of the liner 3 when the engagement openings 30 are engaged with the corresponding retaining members 35.

The retaining members 35 and the first and second tooth elements 42 and 44 are of similar material to that of the basin 2 and are integrally formed in one piece with the basin 2.

The capacity of the basin 2 is approximately 7 liters. The basin 2 is substantially rectangular in plan view of internal length of approximately 320 mm, of internal width of approximately 270 mm, and the internal height of the peripheral wall 6 is approximately 145 mm. The dimensions of the liner 3 substantially correspond with the internal dimensions of the basin 2, with the exception that the height of the peripheral wall 19 of the liner 3 is approximately twice the height of the peripheral wall 6 of the basin 2.

In use, one of the liners 3 is detached from the roll (not shown) of the liners 3, and is erected to form the base 18 and the side and end walls 20 and 21. The liner 3 is then placed in the hollow interior region 12 of the basin 2 with the base 18 of the liner 3 abutting and aligned with the base 5 of the basin 2, and with the side and end walls 20 and 21 of the liner 3 abutting and aligned with the side end walls 8 and 9, respectively, of the basin 2. The peripheral wall 19 of the liner 3 is then folded downwardly over the radiused upper peripheral edge 14 of the peripheral wall 6 of the basin 2, so that the portion of the peripheral wall 19 which is folded down over the upper peripheral edge 14 of the peripheral wall 6 of the basin 2 is located exteriorly of the basin 2 covering most of the exterior surface 13 of the peripheral wall 6 of the basin 2. The portions 32 of the peripheral wall 19 of the liner 3 adjacent the engagement openings 30 are then pulled further downwardly to clear the distal ends 38 of the corresponding retaining members 35, and the retaining members 35 are engaged in the engagement openings 30 with the corresponding portions 32 of the peripheral wall 19 of the liner 3 engaged between the first and second tooth elements 42 and 44, respectively, in the gaps 40 between the corresponding retaining members 35 and the portion 39 of the exterior surface 13 of the retaining member accommodating recesses 37. The apparatus 1 with the liner 3 located in the hollow interior region 12 of the basin 2 and secured to the basin 2 by the retaining members 35 engaging the corresponding engagement openings 30 of the liner 3 is ready for use. The liner 3 in the basin 2 is charged with water, and the patient is then washed with the water. On completion of washing of the patient, the water is emptied from the liner 3, and the liner 3 is disengaged from the basin 2 by disengaging the engagement openings 30 from the retaining members 35. The liner 3 is then removed from the basin 2 for disposal. If a person washing the patient is wearing disposable gloves, once the engagement openings 30 are disengaged from the retaining members 35, the disposable gloves are placed in the liner 3 prior to removal from the basin 2, and as the liner 3 is being removed from the basin 2, the disposable gloves are wrapped in the liner 3, which is then disposed of.

Referring now to FIGS. 18 to 27, there is illustrated apparatus according to another embodiment of the invention, indicated generally by the reference numeral 50, for washing a patient. The apparatus 50 is substantially similar to the apparatus 1 and similar components are identified by the same reference numerals. The apparatus 50 comprises a basin 52 which is substantially similar to the basin 2 of the apparatus 1, and a liner 53 which is also substantially similar to the liner 3 of the apparatus 1.

The main difference between the basin 52 of the apparatus 50 and the basin 2 of the apparatus 1 is that the retaining member accommodating recesses 37 are located in the peripheral wall 6 of the basin 52 at a level above the base 5 of the basin 52 which is greater than the level at which the retaining member accommodating recesses 37 are located in the peripheral wall 6 of the basin 2. Additionally, the retaining members 35 are likewise located at a higher level in the peripheral wall 6 of the basin 52 than those in the peripheral wall 6 of the basin 1. Additionally, first and second tooth elements are omitted from the retaining members 35 and the corresponding retaining member accommodating recesses 37 in the basin 52. Otherwise, the basin 52 is substantially similar to the basin 2 of the apparatus 1.

The main difference between the liner 53 and the liner 3 of the apparatus 1 is that firstly, the height of the peripheral wall 19 of the liner 53 is shorter than the height of the peripheral wall 19 of the liner 3 of the apparatus 1. In this embodiment of the invention the height of the peripheral wall 19 of the liner 53 is approximately one and a half times the height of the peripheral wall 6 of the basin 52. Additionally, the engagement openings 30 in the liner 53 are formed by respective loops 55 which extend from the upper peripheral edge 24 of the peripheral wall 19 of the liner 53 at spaced apart locations 56 adjacent the corners 27 to define with the upper peripheral edge 24 of the peripheral wall 19 between the locations 56 the corresponding engagement openings 30. The loops 55 are of material similar to the material of the liner 53 and are integrally formed in one piece with the liner 53. Otherwise, the liner 53 is similar to the liner 3 of the apparatus 1.

The materials of the basin 52 and the liner 53 are similar to the materials of the basin 2 and the liner 3, respectively, of the apparatus 1.

In use, the liner 53 is placed in the hollow interior region 12 of the basin 52 with the base 18 of the liner 53 abutting and aligned with the base 5 of the basin 52. The side and end walls 20 and 21 of the liner 53 are also located abutting and aligned with the side and end walls 8 and 9 of the basin 52. The peripheral wall 19 of the liner 53 is then folded downwardly over the upper peripheral edge 14 of the peripheral wall 6 of the basin 52, and the loops 55 are stretched downwardly below the distal ends 38 of the corresponding retaining members 35 of the basin 52 for engaging the retaining members 35 in the engagement openings 30 with the loops 55 engaged in the gap 40 between the corresponding retaining members 35 and the portions 39 of the exterior surface 13 in the retaining member accommodating recesses 37.

Otherwise, use of the apparatus 50 is similar to that of the apparatus 1.

While the basins have been described as being of a particular size, shape and capacity and of particular materials, the basins may be of any size, shape or capacity, and may be of any other suitable materials, be the material a plastics material or otherwise, and may be formed by any other suitable forming process.

While the liners have been described as being of a particular size, shape and capacity, it will be readily apparent to those skilled in the art that the liners may be of any other suitable size, shape and capacity, and in general, the liners typically will be of a shape which substantially corresponds to that of the corresponding basin.

While the liners have been described as being of particular materials, it will be readily apparent to those skilled in the art that the liners may be of any other suitable material or materials, and formed by any suitable process.

While four engagement openings and four corresponding retaining means have been provided on the liner and the basin, respectively, any number of engagement openings and retaining means may be provided, and indeed, in certain cases, it is envisaged that two engagement openings and two corresponding retaining means may be sufficient. It will also be appreciated that the retaining means and the engagement openings may be provided at locations other than corner locations.

Needless to say, any other suitable engagement openings and retaining means may be provided, and while the retaining members have been described as being located in retaining member accommodating recesses, while this is preferable, it is not essential.

While the basins and the liners have been described for use in washing or bathing a patient in bed, the basins and liners may be used for any other purpose, and are particularly suitable for use where one wishes to eliminate or at least minimise the transfer of infections, diseases and the like.

While the materials of the liners have been described as capable of withstanding water temperatures of up to 106° F., it will be appreciated that liner materials capable of withstanding higher or lower temperatures may be used.

While the materials of the liners and the basins have been described as comprising an antimicrobial additive, it is envisaged that in certain cases, the antimicrobial additive may be omitted. However, it will be appreciated that it would be desirable to at least provide the liner material with an antimicrobial additive, although this, while it would be desirable, is not essential. Needless to say, other antimicrobial additives instead of the antimicrobial additive described may be used in either or both the basin and the liner.

It will also be appreciated that while the basin has been described as being of a specific capacity and specific dimensions, the basin may be of any other suitable capacity and other suitable dimensions. However, in general, the capacity of the basin would lie in the range of 3 to 7 liters, and in general, in the range of 4 to 5 liters. Typically, the internal length of the basin would range from 250 mm to 400 mm, and the internal width of the basin would range from 200 mm to 350 mm. In general, it is envisaged that the internal height of the basin, in other words, the internal height of the peripheral wall of the basin from the base to the upper peripheral edge thereof would lie in the range of 100 mm to 250 mm.

The invention claimed is:

1. A basin comprising:

a base, a peripheral wall extending around the base and extending in a generally upwardly direction from the base and terminating in an upper peripheral edge, the base and the peripheral wall defining a hollow interior region and an exterior surface, the upper peripheral edge of the peripheral wall defining an open mouth to the hollow interior region, at least two spaced apart retaining means located on the basin for releasably engaging and retaining a liner lining the hollow interior region of the basin, each retaining means comprising a retaining member extending downwardly from the exterior surface of the basin and defining with the exterior surface of the basin a gap therebetween for accommodating a portion of the liner therein, and at least one tooth element extending from one of each of the retaining members and the exterior surface of the basin adjacent each retaining member into the gap towards the other one of the corresponding retaining member and the exterior surface of the basin, each tooth element terminating short of the said other one of the corresponding retaining member and the exterior surface of the basin for releasably retaining the corresponding portion of the liner therebetween.

2. A basin as claimed in claim 1 in which at least one of the tooth elements extends from each of the retaining members and the exterior surface of the basin adjacent each of the retaining members, the tooth elements extending from the exterior surface of the basin adjacent each of the retaining members and the corresponding retaining member cooperating with each other for releasably retaining the corresponding portion of the liner therebetween.

3. A basin as claimed in claim 2 in which the number of the tooth elements extending from the exterior surface of the basin adjacent each of the retaining members and the number of tooth elements extending from the corresponding retaining member differs by one tooth element, and the at least one tooth element extending from the one of the exterior surface of the basin adjacent each retaining member and the corresponding retaining member with the least number of tooth elements extends between the tooth elements extending from the other one of the exterior surface of the basin and the retaining member.

4. A basin as claimed in claim 2 in which the number of the tooth elements extending from each of the retaining members is less than the number of the tooth elements extending from the exterior surface of the basin adjacent the corresponding retaining member.

5. A basin as claimed in claim 2 in which the tooth elements extending from the exterior surface of the basin adjacent each of the retaining members and the tooth elements extending from the corresponding retaining member extend substantially parallel to each other.

6. A basin as claimed in claim 1 in which the at least one tooth element extending from each of the retaining members extends substantially longitudinally along the corresponding retaining member.

7. A basin as claimed in claim 1 in which each retaining member is located in a corresponding retaining member accommodating recess formed into the exterior surface of the basin.

8. A basin as claimed in claim 7 in which each retaining member extends from the basin in the corresponding retaining member accommodating recess.

9. A basin as claimed in claim 7 in which each retaining member accommodating recess extends into the base.

10. A basin as claimed in claim 7 in which each retaining member extends into the corresponding retaining member accommodating recess.

11. A basin as claimed in claim 7 in which each retaining member accommodating recess is formed in the peripheral wall of the basin.

12. A basin as claimed in claim 1 in which the retaining members are equi-spaced apart around the peripheral wall of the basin.

13. A basin as claimed in claim 1 in which the peripheral wall of the basin comprises a pair of spaced apart side walls extending upwardly from the base, and a pair of spaced apart end walls extending upwardly from the base and joining the side walls, the side and end walls defining corners of the peripheral wall, and each retaining member is located adjacent a corresponding one of the corners of the peripheral wall.

14. A basin as claimed in claim 13 in which the corners of the peripheral wall of the basin are radiused corners.

15. A basin as claimed in claim 1 in which each retaining member is located intermediate the base and the upper peripheral edge defined by the peripheral wall.

16. A basin as claimed in claim 1 in which the basin comprising a plastics material, the plastics material of the basin comprising an antimicrobial additive.

17. A basin as claimed in claim 16 in which the antimicrobial additive comprises an inorganic silver based component in an inert glass carrier.

18. A basin as claimed in claim 1 in which two tooth elements extent from each retaining member.

* * * * *